United States Patent [19]

Galow et al.

[11] 3,959,086

[45] May 25, 1976

[54] MULTI-INLET HOPPER ARRANGEMENT FOR FILLING SUCCESSIVE ONES OF A BATTERY OF FURNACE CHAMBERS

[75] Inventors: Manfred Galow; Heinz Osterberg, both of Essen, Germany

[73] Assignees: Bergwerksverband GmbH; Didier Engineering GmbH, both of Essen, Germany

[22] Filed: July 16, 1974

[21] Appl. No.: 491,433

[30] Foreign Application Priority Data

July 18, 1973 Germany ..... 2336515

[52] U.S. Cl. ..... 202/262; 202/263; 110/101 R; 214/18 PH; 214/41 R

[51] Int. Cl.[2] ..... C10B 31/02

[58] Field of Search ..... 202/263, 262; 110/101 R; 214/18 PH, 41; 141/93, 232, 105

[56] References Cited

UNITED STATES PATENTS

| | | | |
|---|---|---|---|
| 1,785,751 | 12/1930 | Van Ackeren | 202/262 X |
| 3,216,595 | 11/1965 | Wethly | 214/18 PH |
| 3,850,756 | 11/1974 | Rossow | 202/262 |

FOREIGN PATENTS OR APPLICATIONS

| | | | |
|---|---|---|---|
| 468,260 | 7/1937 | United Kingdom | 202/263 |

*Primary Examiner*—James H. Tayman, Jr.
*Attorney, Agent, or Firm*—Michael J. Striker

[57] ABSTRACT

A plurality of coke oven chambers is provided with respective filling inlets arranged in a row. A coal conveyor arrangement is located above such row and extends in the direction of the row. The coal conveyor arrangement is provided with a plurality of outlet units spaced from each other along the length of the row. A filling arrangement is operative for conveying coal from the outlet units to the filling inlets. The filling arrangement comprises a hopper movable along the length of the row of filling inlets and provided with a plurality of inlet units arranged to successively register with the outlet units and provided with at least one outlet unit communicating inside the hopper with the inlet units and arranged to register with successive ones of the filling inlets. The inlet units of the hopper and the at least one outlet unit of the hopper are so disposed that, when the outlet unit of the hopper registers with one of the filling inlets, one of the inlet units of the hopper registers with one of the outlet units of the coal conveying arrangement.

8 Claims, 1 Drawing Figure

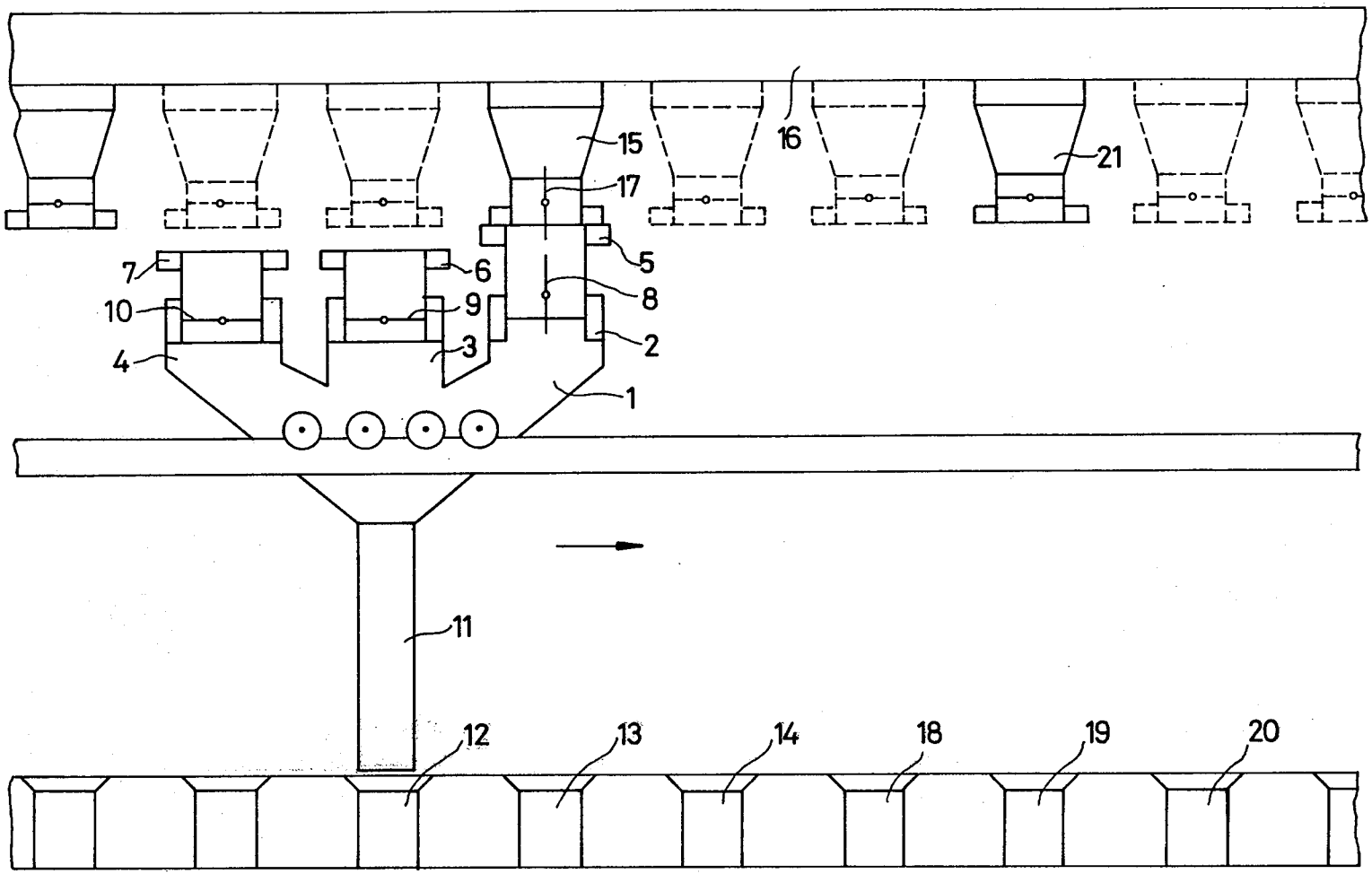
1
2
3
4
5
6
7
8
9
10
11
12
13
14
15
16
17
18
19
20
21

MULTI-INLET HOPPER ARRANGEMENT FOR FILLING SUCCESSIVE ONES OF A BATTERY OF FURNACE CHAMBERS

BACKGROUND OF THE INVENTION

The invention relates to the problem of filling the successive furnace chambers of a battery of coke ovens, or the like, with cold or preheated coal by means of a coal conveying arrangement extending in the direction in which the battery of coke ovens extends. More particularly, the invention relates to the problem of so filling the furnace chambers that dust and gas is prevented from freely escaping into the atmosphere during the filling.

It is already very well known to make use of chain conveyors (drag-link conveyors) for the purpose of filling the furnace chambers of a battery of coke ovens with moist or preheated coal. One such method is disclosed, for example, in West German Offenlegungsschrift No. 2,020,261. According to this method, cold or preheated coal is fed into the chambers of the battery of coke ovens by means of a permanently mounted chain conveyor which extends lengthwise in the direction of the row of filling inlets of the furnace chambers of the battery. The chain conveyor is provided with a plurality of outlet units, each one permanently associated with and positioned directly above a respective one of the filling inlets of the row of filling inlets. The outlet units of the permanently mounted chain conveyor can be gas-tightly and dust-tightly sealed. The actual feeding of the coal from the outlet units of the chain conveyor to the filling inlets of the furnace chambers is accomplished by means of an intermediate arrangement mounted on a frame which is movable along the length of the row of filling inlets. The intermediate arrangement can be of many different forms. In the publication referred to above, the intermediate arrangement consists of two intermediate conveyors which can be blocked off by a type of valve arrangement and which is provided with pipes insertable into two of the filling inlets.

Prior-art arrangements of this type have the disadvantage that they require that the chain conveyor be provided with one outlet unit for each filling unit of the battery of coke ovens. Each of these outlet units is conventionally provided with some type of valve arrangement capable of sealing off the outlet unit in a dust-tight and gas-tight manner. The provision of these valve arrangements makes the outlet units of the chain conveyor very expensive, and when preheated coal is being conveyed these outlet units must be continuously watched over.

SUMMARY OF THE INVENTION

It is the general object of the invention to provide an arrangement of the general type in question which is of such a design as to greatly reduce the number of outlet units with which the elongated coal conveying arrangement must be provided.

This object, and others which will become more understandable from the description, below, of a preferred embodiment, can be met, according to one advantageous concept of the invention, by providing, in combination with a battery of coke oven chambers provided with respective filling inlets arranged in a row and a coal conveyor arrangement located above the row and extending lengthwise of the row and provided with a plurality of outlet units spaced from each other along the length of the row, a filling arrangement for conveying coal from the outlet units to the filling inlets. Advantageously, the filling arrangement comprises a hopper movable along the length of the row. The hopper arrangement is provided with a plurality of inlet units arranged to register with successive ones of the outlet units and provided with at least one outlet unit communicating inside the hopper with the inlet units and arranged to register with successive ones of the filling inlets. The inlet units of the hopper and the at least one outlet unit of the hopper are so disposed that, when the outlet unit of the hopper registers with one of the filling inlets, one of the inlet units registers with one of the outlet units of the coal conveyor arrangement.

According to a further advantageous concept of the invention, successive ones of the filling inlets are spaced apart by a predetermined distance, and successive ones of the outlet units of the coal conveyor arrangement are spaced apart by $n$ times the predetermined distance, where $n$ is an integer greater than unity. Furthermore, the hopper is provided with $n$ inlet units spaced apart by the predetermined distance. Accordingly, the filling of $n$ successive ones of the filling inlets can be effected by causing the $n$ successive ones of the inlet units to be successively brought into registry with a single one of the outlet units of the coal conveyor arrangement. This greatly reduces the number of expensive outlet units with which the coal conveyor arrangement need be provided. For example, if $n = 3$, then there is a reduction by two-thirds in the number of outlet units with which the coal conveyor arrangement need be provided, as compared to prior-art set-ups. If $n = 5$, for example, then there is a reduction by four-fifths in the number of outlet units with which the coal conveyor arrangement need be provided, as compared to prior-art set-ups.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE depicts one exemplary embodiment of the invention.

DESCRIPTION OF THE PREFERRED EMBODIMENTS

In the illustrated, merely exemplary embodiment of the invention, there is provided a three-inlet hopper arrangement 1, provided at its top with three inlet units 2, 3, 4. Each of the inlet units 2, 3, 4 is provided with a respective annular telescoped portion 5, 6 or 7 received in and slidable in the respective inlet unit 2, 3, 4 from a retracted to an operative position. In the FIGURE, the telescoped portion 5 is shown in the operative position, whereas the telescoped portions 6 and 7 are shown in the retracted position.

Each of the telescoped portions 5, 6, 7 is provided with a respective valve member 8, 9 or 10 of circular cross section mounted for pivoting movement about a pivot axis coincident with a diameter of the bore of the respective one of the portions 5, 6, 7. When the respective valve member 8, 9, 10 is in the horizontal position, as shown with respect to valve members 9 and 10, the bore of the respective one of portions 5, 6, 7 is dust-tightly and gas-tightly closed off. When the respective valve member 8, 9, 10 is in the vertical position, as shown with respect to valve member 8, the bore of the respective one of portions 5, 6, 7 is in the fully open position.

At its bottom the hopper arrangement 1 is provided with a pipe-shaped outlet or filling unit 11. The diameter of the outlet 11 corresponds to the diameter of the filling inlets 12, 13, 14, 18, 19, 20 of successive furnace chambers in the battery of furnace chambers.

Above the collecting hopper arrangement 1 there is provided a chain conveyor 16 cooperating with three outlet units, of which two are respectively designated 15 and 21. The outlet units shown in broken lines correspond to the outlet units which would be required with prior-art constructions, it being evident that in the illustrated embodiment the number of outlet units cooperating with the chain conveyor 16 is reduced by two-thirds.

Each of the outlet units contains a schematically depicted valve arrangement 17 similar in its basic operation to the valve members 8, 9, 10 described above.

The three-inlet one-outlet hopper arrangement 1 is mounted by non-illustrated means for movement along the length of the row formed by the filling inlets 12, 13, 14, 18, 19, 20. For example, the main body of the hopper arrangement 1 can be provided with wheels rolling on rails located to either side of the hopper arrangement 1, with photoelectric or other position-detecting means of a conventional nature being provided in order to determine when the outlet 11 of the hopper arrangement 1 is lined up with one of the filling inlets 12, 13, 14, etc.

If, for example, the three furnace chambers provided with the respective filling inlets 12, 13, 14 are to be filled in that order, the filling operation proceeds as follows:

The collecting hopper arrangement 1 is positioned with its outlet 11 directly above and lined up with the filling inlet 12 of the first of the three furnace chambers to be filled. As a result of the relative positions between the outlets 15, 21, etc., and the filling inlets 12, 13, 14, etc., the inlet unit 2 of the hopper arrangement 1 is lined up directly below the outlet unit 15 of the chain conveyor arrangement 16.

Thereupon, the telescoping portion 5 associated with the inlet unit 2 is moved to the illustrated non-retracted or operative position. For example, the telescoping portion 5 may be connected to the pistons of a plurality of hydraulic cylinder and piston units or other conventional moving means. The upper surface of the radially outwardly extending portion of the telescoping portion 5 is provided with sealing means, such as a ring of sealing material. When the telescoping portion 5 is moved to the operative position, it presses with its sealing ring against the lower surface of the outlet unit 15, forming a seal-tight connection between the two facing surfaces. The connection is both gas-tight and dust-tight. Thereafter, the valve arrangement 8 of the inlet unit 2 and the valve arrangement 17 of the outlet unit 15 associated with the chain conveyor are both moved to open position. As a result, coal pours down out through outlet unit 15 into inlet unit 2, out the outlet 11 of hopper arrangement 1, and into the filling inlet 12 of the first of the three furnace chambers to be filled. This stage of operation is depicted in the drawing.

Next, the furnace chamber provided with the filling inlet 13 is to be filled. First, the valve arrangements 8 and 17 are returned to their closed positions, and then the telescoping portion 5 is caused to retract by hydraulic or other conventional means. Thereafter, the hopper arrangement 1 is shifted rightwards until its outlet unit 11 is directly above and lined up with the filling inlet 13 of the next furnace chamber to be filled. Now, it is the inlet unit 3 with its telescoping portion 6 which is lined up with the outlet unit 15 of the chain conveyor 16. The telescoping portion 6 is caused to move to its non-retracted or operative position, as was explained with reference to the portion 5, and the valve arrangements 17 and 9 are both opened. Accordingly, coal will pour down from the outlet unit 15 through the hopper arrangement 1 and into the filling inlet 13.

After the furnace chamber provided with the filling inlet 13 has been filled, the valve arrangements 9 and 17 are closed, the telescoping portion 6 is caused to retract, and the entire hopper arrangement 1 is shifted rightwards until the outlet unit 11 thereof is in registry with the filling inlet 14 of the next furnace chamber to be filled. Now, it is the inlet unit 4 of the hopper arrangement 1 which is in registry with the outlet unit 15 of the chain conveyor arrangement 16.

In order to fill the furnace chamber provided with the filling opening 18, the hopper arrangement 1 must be shifted further rightwards until the inlet unit 2 thereof is in registry with the next outlet unit 21 of the chain conveyor arrangement 16. The outlet 11 of the hopper arrangement 1 will be in registry with the filling inlet 18. To fill the furnace chambers respectively provided with the filling inlets 19 and 20, the hopper arrangement 1 is shifted so that the inlet units 3 and 4, respectively, are brought into registry with the outlet unit 21.

It will be evident that for the filling of from three to five furnace chambers only a single outlet unit for the conveyor arrangement 16 is required. In the case of conventional arrangements each furnace chamber to be filled had associated with it one respective outlet unit of the conveyor arrangement 16, as indicated in broken lines in the FIGURE.

With the present invention, it is accordingly possible to reduce the number of conveyor arrangement outlet units, with their expensive valve arrangements, by from two-thirds up to four-fifths, or more. A reduction of the number of conveyor arrangement outlet units by four-fifths would evidently result if a single conveyor arrangement outlet unit were provided for each five of the furnace chamber filling inlets. It is also contemplated according to the invention to provide the hopper arrangement 1 with a plurality of outlet units each communicating with a plurality of inlet units and spaced apart a distance corresponding, for example, to the distance between successive filling inlets or a multiple thereof.

It will be understood that each of the elements described above, or two or more together, may also find a useful application in other types of constructions differing from the type described above.

While the invention has been illustrated and described as embodied in an arrangement for feeding coal into the filling inlets of a battery of furnace chambers, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an apparatus for successively supplying coal to filling inlets of a battery of coke oven chambers, which filling inlets are arranged in at least one row and spaced a predetermined distance from one another in a longitudinal direction of the row, a combination comprising a filling arrangement above the battery and including a plurality of inlet units which are spaced by said distance in said direction, at least one filling unit above the row, a closed hopper connecting and communicating said inlet units with said filling unit, and a plurality of closing means for selectively closing said inlet units; a coal conveyor extending in said direction above said filling arrangement and having a plurality of outlet units which are spaced a multiple of said distance in said direction; and means for mounting said filling arrangement for movement in said direction to a plurality of filling positions in each of which said filling unit is aligned and communicates with a respective filling inlet said filling arrangement being so configurated that in each of said filling positions thereof one inlet unit is aligned with one outlet unit of said conveyor, each inlet unit including sealing means for establishing a gas-tight and dust-tight registration between such inlet unit and an outlet unit of the conveyor when such inlet unit and outlet unit are aligned, said closing means of only the aligned inlet unit being open to establish direct communication of said one outlet unit of said conveyor with the respective filling inlet of the battery, whereby coal discharged by said one outlet unit passes into the aligned inlet unit without escaping into the ambient environment and then falls through the filling arrangement and is discharged into one of the filling inlets of the battery.

2. The combination defined in claim 1, wherein successive ones of said outlet units of said coal conveyor arrangement are spaced apart by *n* times said predetermined distance, wherein *n* is an integer greater than unity, and wherein said hopper is provided wih *n* inlet units, spaced apart by said predetermined distance, whereby the filling of *n* successive ones of said filling inlets can be effected by causing the *n* successive ones of said inlet units to be successively brought into registry with a single one of said outlet units of said coal conveyor.

3. The combination defined in claim 1, wherein said hopper is provided with two filling units both communicating inside said hopper with a plurality of said inlet units.

4. The combination defined in claim 3, wherein said two filling units of said hopper are spaced apart a distance corresponding to the spacing between two successive ones of said filling inlets

5. The combination defined in claim 1, wherein said closing means of each of said inlet units includes a respective valve arrangement movable between an open position and a gas-tightly and dust-tightly sealed closed position.

6. The combination defined in claim 1, wherein each of said inlet units of said hopper and each of said outlet units of said coal conveyor arrangement is provided with a respective valve arrangement moveable between an open position and a gas-tightly and dust-tightly sealed closed position.

7. The combination defined in claim 2, wherein each of said inlet units of said hopper and each of said outlet units of said coal conveyor is provided with a respective valve arrangement movable between an open position and a gas-tightly and dust-tightly sealed closed position.

8. The combination defined in claim 1, wherein each sealing means is comprised of a telescoping portion movable from a retracted position to a non-retracted working position in which it gas-tightly and dust-tightly registers with one of said outlet units of said coal conveyor arrangement to form with such one of said outlet units of said coal conveyor a gas-tightly and dust-tightly sealed conduit for the passage of coal from said coal conveyor into the interior of said hopper.

* * * * *